US011864661B2

(12) United States Patent
Deevers et al.

(10) Patent No.: US 11,864,661 B2
(45) Date of Patent: Jan. 9, 2024

(54) BODY SUPPORT ASSEMBLY AND METHODS FOR THE USE AND ASSEMBLY THEREOF

(71) Applicant: Steelcase Inc., Grand Rapids, MI (US)

(72) Inventors: Nickolaus William Charles Deevers, E Grand Rapids, MI (US); Gordon J. Peterson, Rockford, MI (US)

(73) Assignee: STEELCASE INC, Grand Rapids, MI (US)

( * ) Notice: Subject to any disclaimer, the term of this patent is extended or adjusted under 35 U.S.C. 154(b) by 0 days.

(21) Appl. No.: 17/733,445

(22) Filed: Apr. 29, 2022

(65) Prior Publication Data

US 2022/0354259 A1 Nov. 10, 2022

Related U.S. Application Data

(60) Provisional application No. 63/184,590, filed on May 5, 2021.

(51) Int. Cl.

| | |
|---|---|
| ***A47C 7/36*** | (2006.01) |
| ***A47C 7/46*** | (2006.01) |
| ***A47C 7/38*** | (2006.01) |

(52) U.S. Cl.

CPC ..... *A47C 7/462* (2013.01); *A47C 7/38* (2013.01)

(58) Field of Classification Search

CPC .. A47C 7/46; A47C 7/441; A47C 7/36; A47C 7/40; A47C 7/7402; A47C 7/405

See application file for complete search history.

(56) References Cited

U.S. PATENT DOCUMENTS

| | | | |
|---|---|---|---|
| 136,531 | A | 3/1873 | Mitchell |
| 171,356 | A | 12/1875 | Cushman |
| 217,169 | A | 7/1879 | Taylor |
| 248,342 | A | 10/1881 | Patchin |
| 258,338 | A | 5/1882 | Wooldridge |
| 363,723 | A | 5/1887 | Brown |
| 409,389 | A | 8/1889 | Campbell |
| 480,822 | A | 8/1892 | Mayes |
| 1,597,355 | A | 8/1926 | Fussell |
| 2,060,298 | A | 11/1936 | Gailey |
| 2,347,859 | A | 5/1944 | Williams |
| 2,557,399 | A | 12/1945 | Teetor |
| 2,613,731 | A | 11/1949 | Roginski |
| 2,560,925 | A | 4/1950 | Brown |
| 2,967,038 | A | 1/1961 | Lennemann |
| 3,001,308 | A | 9/1961 | Potter |

(Continued)

FOREIGN PATENT DOCUMENTS

| | | | |
|---|---|---|---|
| CN | 201160674 | Y | 12/2008 |
| CN | 202820220 | U | 3/2013 |

(Continued)

OTHER PUBLICATIONS

International Search Report for International Application No. PCT/US22/27018 dated Jul. 29, 2022 (2 pages).

(Continued)

*Primary Examiner* — Shin H Kim

(74) *Attorney, Agent, or Firm* — Crowell & Moring LLP

(57) ABSTRACT

A body support assembly includes a moveable body support member coupled to a deflectable suspension material. Methods of using and assembling the body support assembly are provided.

20 Claims, 10 Drawing Sheets

(56) References Cited

U.S. PATENT DOCUMENTS

| | | | | |
|---|---|---|---|---|
| 3,104,914 | A | 9/1963 | Burton | |
| 3,317,244 | A | 10/1965 | Ferro | |
| 3,271,072 | A | 9/1966 | Barker | |
| 3,279,849 | A | 10/1966 | Radke et al. | |
| 3,464,752 | A | 9/1969 | Froelich | |
| 3,670,435 | A | 6/1972 | Steward | |
| 3,709,535 | A | 1/1973 | Rothermel | |
| 3,756,654 | A | 9/1973 | Bauer | |
| 3,880,465 | A | 4/1975 | Scheben | |
| 3,948,558 | A | 4/1976 | Obermeier et al. | |
| 3,975,050 | A | 8/1976 | McKee | |
| 4,101,167 | A | 7/1978 | Örnberg | |
| 4,161,337 | A | 7/1979 | Ross et al. | |
| 4,236,331 | A | 12/1980 | Mattson | |
| 4,362,334 | A | 12/1982 | Ross et al. | |
| 4,408,800 | A | 10/1983 | Knapp | |
| 4,555,085 | A | 11/1985 | Bauer et al. | |
| 4,603,905 | A | 8/1986 | Stucki | |
| 4,642,257 | A | 2/1987 | Chase | |
| 4,711,491 | A | 12/1987 | Ginat | |
| 4,711,492 | A | 12/1987 | Asbjornsen et al. | |
| 4,752,101 | A | 6/1988 | Yurchenco et al. | |
| 4,800,662 | A | 1/1989 | Belrose | |
| 4,818,020 | A | 4/1989 | Meiller et al. | |
| 4,862,536 | A | 9/1989 | Pruit | |
| 4,892,354 | A | 1/1990 | Estkowski et al. | |
| 4,909,472 | A | 3/1990 | Piretti | |
| 4,915,449 | A | 4/1990 | Piretti | |
| 5,035,466 | A | 7/1991 | Mathews et al. | |
| 5,054,726 | A | 10/1991 | Mattox | |
| 5,106,157 | A | 4/1992 | Nagelkirk et al. | |
| 5,112,106 | A * | 5/1992 | Asbjornsen | A47C 7/405 297/284.7 |
| 5,192,114 | A | 3/1993 | Hollington et al. | |
| 5,222,783 | A | 6/1993 | Lai | |
| 5,259,663 | A | 11/1993 | Ambasz | |
| 5,280,998 | A | 1/1994 | Miotto et al. | |
| 5,322,345 | A | 6/1994 | Desser et al. | |
| 5,427,434 | A | 6/1995 | Hybarger | |
| 5,533,787 | A | 7/1996 | Xiang | |
| 5,551,752 | A | 9/1996 | Lovegrove et al. | |
| 5,765,804 | A | 6/1998 | Stumpf et al. | |
| 5,776,085 | A | 7/1998 | Stone et al. | |
| 5,791,733 | A | 8/1998 | Van Hekken et al. | |
| 5,809,582 | A | 9/1998 | Lane | |
| 5,897,472 | A | 4/1999 | Thulasigam | |
| 6,158,808 | A | 12/2000 | Margolis et al. | |
| 6,174,031 | B1 | 1/2001 | Lindgren et al. | |
| 6,179,377 | B1 | 1/2001 | Harper | |
| 6,199,952 | B1 | 3/2001 | Davis | |
| 6,220,664 | B1 | 4/2001 | Lee | |
| 6,276,755 | B1 | 8/2001 | Su | |
| 6,299,248 | B1 | 10/2001 | Gennaro et al. | |
| 6,352,308 | B1 | 3/2002 | Chen | |
| 6,378,943 | B1 | 4/2002 | Beggs et al. | |
| 6,419,320 | B1 | 7/2002 | Wang | |
| 6,439,661 | B1 | 8/2002 | Bräuning | |
| 6,450,577 | B1 | 9/2002 | Roslund, Jr. | |
| 6,464,294 | B1 | 10/2002 | Kain | |
| 6,488,336 | B1 | 12/2002 | Wang | |
| 6,598,936 | B1 | 7/2003 | Klein | |
| 6,619,740 | B2 | 9/2003 | Beggs | |
| 6,692,077 | B1 | 2/2004 | Beggs et al. | |
| 6,779,847 | B2 | 8/2004 | Klein | |
| 6,783,180 | B1 | 8/2004 | Young | |
| 6,916,067 | B2 | 7/2005 | Liu | |
| 6,957,862 | B2 | 10/2005 | Chen | |
| 7,021,718 | B2 | 4/2006 | Coffield et al. | |
| 7,204,557 | B1 | 4/2007 | Burton | |
| 7,207,630 | B1 | 4/2007 | Reynolds | |
| 7,303,233 | B2 | 12/2007 | Kitahata | |
| 7,393,057 | B2 | 7/2008 | Fraser | |
| 7,490,395 | B2 | 2/2009 | Coffield et al. | |
| 7,887,135 | B2 | 2/2011 | Oda | |
| 8,419,134 | B1 | 4/2013 | Yuan | |
| 8,480,171 | B2 | 7/2013 | Chadwick et al. | |
| 8,544,958 | B2 | 10/2013 | Holtzinger et al. | |
| 8,944,510 | B2 * | 2/2015 | Yuan | A47C 7/38 297/284.7 |
| 8,991,922 | B2 | 3/2015 | Bisman et al. | |
| 9,045,064 | B2 | 6/2015 | Weigert | |
| 9,301,615 | B2 | 4/2016 | Behar et al. | |
| 9,538,849 | B2 | 1/2017 | Beyer et al. | |
| 10,667,613 | B2 | 6/2020 | Harris | |
| 2004/0130452 | A1 | 7/2004 | Cherebini | |
| 2005/0121958 | A1 | 6/2005 | Edwards et al. | |
| 2005/0134097 | A1 | 6/2005 | Su | |
| 2005/0077766 | A1 | 7/2005 | Chen | |
| 2005/0173958 | A1 | 8/2005 | De Martin | |
| 2005/0179295 | A1 | 8/2005 | Catanzarite et al. | |
| 2005/0253434 | A1 | 11/2005 | Bowman | |
| 2006/0006715 | A1 | 1/2006 | Chadwick et al. | |
| 2008/0309139 | A1 | 12/2008 | Oda | |
| 2012/0139321 | A1 | 6/2012 | Wu | |
| 2014/0292052 | A1 | 10/2014 | Parker et al. | |
| 2016/0353895 | A1 | 12/2016 | Lakshmi Narasimhan | |
| 2021/0204699 | A1 | 7/2021 | Deevers et al. | |

FOREIGN PATENT DOCUMENTS

| | | | |
|---|---|---|---|
| CN | 203046983 | U | 7/2013 |
| CN | 103802696 | A | 5/2014 |
| CN | 204994996 | U | 1/2016 |
| CN | 106114309 | A | 11/2016 |
| CN | 107472090 | | 12/2017 |
| CN | 108367696 | | 8/2018 |
| CN | 209018151 | U | 6/2019 |
| CN | 212400987 | U | 1/2021 |
| CN | 212437956 | U | 2/2021 |
| DE | 101 55 263 | | 1/2003 |
| DE | 10 2004 020 061 | A1 | 11/2005 |
| DE | 20 2006 007 913 | U1 | 9/2006 |
| DE | 20 2006 008 664 | U1 | 9/2006 |
| FR | 1 119 019 | | 6/1956 |
| FR | 2 298 297 | | 8/1976 |
| GB | 1 315 249 | | 5/1973 |
| JP | 2003-169836 | | 6/2003 |
| JP | 2007/135629 | A1 | 6/2007 |
| JP | 4176462 | | 11/2008 |
| JP | 4704892 | | 6/2011 |
| JP | 4718975 | | 7/2011 |
| JP | 5007444 | | 8/2012 |
| JP | 2017-86429 | A | 5/2017 |
| JP | 6537827 | | 7/2019 |
| KR | 20-1996-0010544 | | 4/1996 |
| KR | 2002-0044524 | | 6/2002 |
| KR | 10-1484669 | B1 | 1/2015 |
| KR | 10-1635485 | | 7/2016 |
| KR | 2018-0007942 | | 1/2018 |
| KR | 10-1867493 | | 6/2018 |
| KR | 2020-0123893 | | 11/2020 |
| WO | WO 94/01021 | | 1/1994 |
| WO | WO 95/00051 | | 1/1995 |
| WO | WO 99/34710 | | 7/1999 |
| WO | WO 01/70075 | A1 | 9/2001 |
| WO | WO 2004/030981 | A1 | 4/2004 |
| WO | WO 2006/014577 | A2 | 2/2006 |

OTHER PUBLICATIONS

Jeffrey Bernett, "Landscage Chaise Longue", Mar. 2, 2021 (3 pages).

* cited by examiner

BODY SUPPORT ASSEMBLY AND METHODS FOR THE USE AND ASSEMBLY THEREOF

This application claims the benefit of U.S. Provisional Application No. 63/184,590, filed May 5, 2021 and entitled "Body Support Assembly and Methods for the Use and Assembly Thereof," the entire disclosure of which is hereby incorporated herein by reference.

FIELD OF THE INVENTION

The present application relates generally to a body support assembly, for example and without limitation a chair, and in particular to a body support assembly having an adjustable body support member supported by a suspension material, together with methods for the use and assembly thereof.

BACKGROUND

Body support assemblies, for example office chairs, may have a primary body support member configured with a suspension material, such as a mesh fabric, that is supported across an opening defined by a frame. Such suspension materials conform to the body of the user, providing micro compliance along with improved air circulation, and the attendant cooling benefit. Typically, the frame is sufficiently rigid in order to maintain an appropriate level of tension in the suspension material when loaded. In some chairs, auxiliary body support structures such as headrests or lumbar supports, may be introduced to provide additional support. Typically, however, such auxiliary body support structures are coupled to the frame and limit the movement of the suspension material, or function independent of the suspension material.

SUMMARY

The present invention is defined by the following claims, and nothing in this section should be considered to be a limitation on those claims.

In one aspect, one embodiment of a body support assembly includes a frame defining an opening. A suspension material is coupled to the frame and covers at least a portion of the opening. At least a portion of the suspension material at a location spaced from the frame is deflectable in a fore/aft direction transverse to the opening. An auxiliary body support assembly includes a support mount coupled to the suspension material at the location spaced from the frame. The support mount is moveable with the portion of the suspension material in the fore/aft direction. A body support member is moveably connected to the support mount. The body support member may be vertically moveable relative to the support mount between at least uppermost and lowermost support positions.

In another aspect, one embodiment of a body support assembly includes a frame and a suspension material coupled to the frame. At least a portion of the suspension material is deflectable in a fore/aft direction relative to the frame. An auxiliary body support assembly includes a support mount coupled to the suspension material. The support mount is moveable with the suspension material in the fore/aft direction. A body support member is moveably connected to the support mount. The body support member is vertically moveable relative to the support mount between at least uppermost and lowermost support positions. The body support member covers an entirety of a front surface of the support mount as the body support member is moved between the uppermost and lowermost support positions.

In yet another aspect, one embodiment of a method of assembling a body support assembly includes providing a suspension material coupled to a frame, wherein at least a portion of the suspension material is deflectable in a fore/aft direction relative to the frame, inserting a guide disposed on one of a body support member or the suspension material into a track disposed on the other of the body support member or the suspension material, wherein the one of the guide or the track disposed on the suspension material is moveable with the suspension material in the fore/aft direction, and rotating the body support member relative to the suspension material and thereby engaging the track with the guide.

The various embodiments of the body support assembly, and methods for the use and assembly thereof, provide significant advantages over other body support assemblies and methods. For example and without limitation, the body support member is coupled to and moveable with the suspension material, such that the body support member does not limit the movement of the suspension material by way of connection to the frame. In addition, the support mount may be coupled to the suspension material such that no portion of the body support member assembly is visible from a rear side of the suspension material. At the same time, the body support member covers the front of the support mount, and the coupling between the body support member and support mount, through the entire range of motion of the body support member, providing the body support member, for example a headrest, with a floating appearance, i.e., a floating headrest. The method of assembly also provides advantages in that the assembly may be completed without tools or auxiliary fasteners such as screws or bolts through the simple manipulation of the body support member relative to the backrest.

The foregoing paragraphs have been provided by way of general introduction, and are not intended to limit the scope of the claims presented below. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
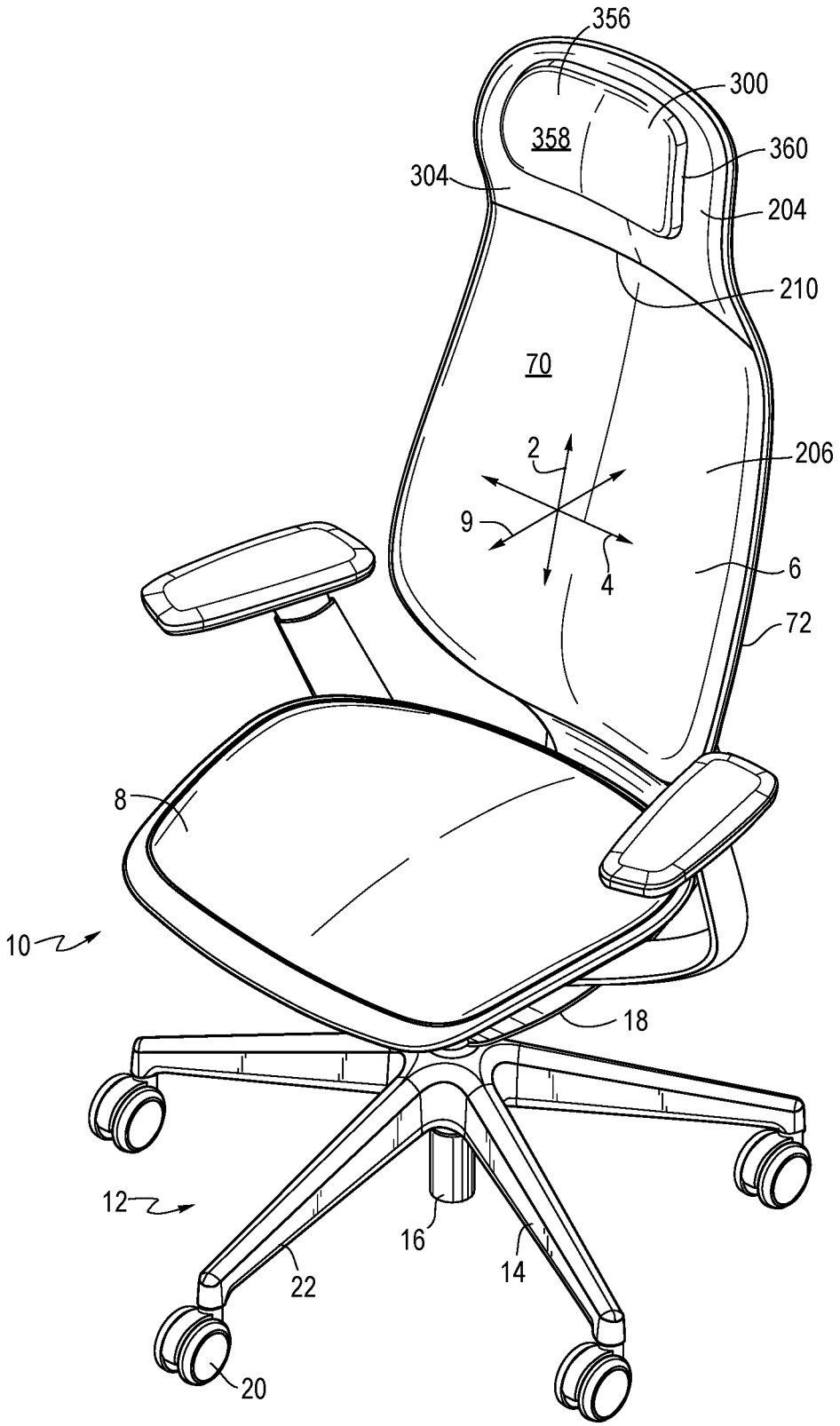
FIG. 1 is a front perspective view of one embodiment of a body support assembly.

It should be understood that the term "plurality," as used herein, means two or more. The term "longitudinal," as used herein means of or relating to a length or lengthwise direction 2, for example a direction running from the bottom of a backrest assembly 6 to the top thereof, or vice versa. The term "lateral," as used herein, means situated on, directed toward or running in a side-to-side direction 4 of a body support assembly 10, shown in one embodiment as an office chair including the backrest assembly 6 and seat assembly 8. It should be understood that the body support assembly may be configured as any structure that supports a body, including without limitation automotive, aircraft and mass-transit seating, beds, home furnishings (including sofas and chairs), and other similar and suitable structures. In one embodiment of a backrest assembly disclosed below, a lateral direction 4 corresponds to a horizontal direction and a longitudinal direction 2 corresponds to a vertical direction. The lateral direction 4 may be referred to as an X direction, while the longitudinal direction 2 refers to a Y direction. A Z direction 9 is orthogonal to the body support surface of both the backrest and seat assemblies 6, 8, and to the plane defined by the X and Y directions.

The term "coupled" means connected to or engaged with, whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," "right," "left," and variations or derivatives thereof, refer to the orientations of an exemplary body support assembly 10, shown as a chair in FIGS. 1 and 2, from the perspective of a user seated therein. The term "transverse" means non-parallel, and includes for example a vector oriented between and not including 0 and 180 degrees relative to a line or plane extending between backrest uprights, including a vector extending orthogonal (90 degrees) to the line or plane. For example, the Z direction 9 is transverse to both the X and Y directions, and in particular is orthogonal to those directions. The term "outwardly" refers to a direction facing away from a centralized location, for example the phrase "radially outwardly" refers to a feature diverging away from a centralized location, for example the middle, central or interior region of a seat or backrest, and lies generally in the X Y plane defined by the lateral and longitudinal directions 2, 4. It should be understood that features or components facing or extending "outwardly" do not necessarily originate from the same centralized point, but rather generally emanate outwardly. Conversely, the term "inwardly" refers to a direction facing toward the centralized or interior location.

The phrase "textile material" refers to a flexible material made of a network of natural or artificial fibers (yarn, monofilaments, thread, etc.). Textile materials may be formed by weaving, knitting, crocheting, knotting, felting, or braiding. Textile materials may include various furniture upholstery materials. The phrase "suspension material" refers to a flexible material, including for example and without limitation a textile material, a thin plastic and/or elastomeric membrane, or other similar material, that may be disposed, stretched and/or put in tension across an opening to support a user. It should be understood that a material extending between a pair of spaced apart supports is considered a "suspension material" even if the material does not have any pre-load (e.g., tension) when connected between the supports, but may be loaded (e.g., put in tension between the supports) when engaged by a user.

Figure 2:
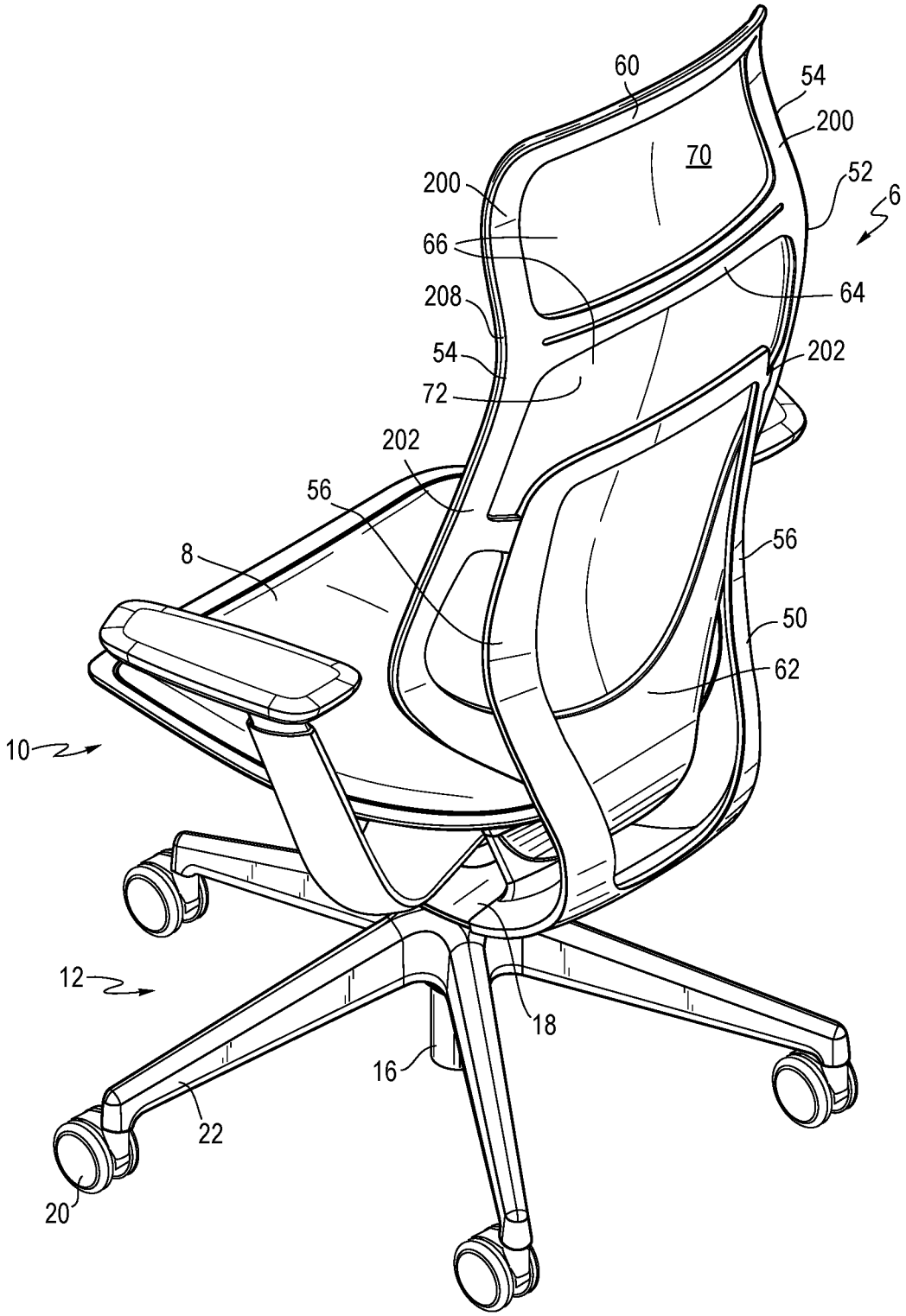
FIG. 2 is a rear perspective view of one embodiment of the body support assembly shown in FIG. 1.

Body Support Assembly:

Referring to FIGS. 1 and 2, the body support assembly 10 is shown as including a tilt control assembly 18, also referred to as a lower support structure, a base structure 12 and the backrest and seat assemblies 6, 8. In one embodiment, the base structure 12 includes a leg assembly 14 and a support column 16 coupled to and extending upwardly from the leg assembly. The tilt control assembly 18 is supported by and coupled to a top of the support column 16. The leg assembly may alternatively be configured as a fixed structure, for example a four legged base, a sled base or other configuration. In one embodiment, the support column 16 may be height adjustable, including for example and without limitation a telescopic column with a pneumatic, hydraulic or electro-mechanical actuator. The leg assembly 14 includes a plurality of support legs 22 extending radially outwardly from a hub surrounding the support column. Ends of each support leg may be outfitted with a caster, glide or other floor interface member 20. Various aspects and features of the body support assembly and suspension material are disclosed in U.S. patent application Ser. No. 17/119,490, filed Dec. 11, 2020 and entitled "Body Support Assembly and Methods for the Use and Assembly Thereof," the entire disclosure of which is hereby incorporated herein by reference.

Suspension Material:

In one embodiment, a suspension material 70 is made of a textile material having an elastomeric woven or knitted material, and may be configured with heat-shrinkable yarns and heat shrinkable elastomeric monofilaments, which shrink in response to the application of energy, for example heat, whether applied by radiation or convection. Various suitable suspension materials are disclosed in U.S. Pat. No. 7,851,390, entitled "Two-Dimensional Textile Material, Especially Textile Fabric, Having Shrink Properties and Products Manufacture Therefrom," the entire disclosure of which is hereby incorporated herein by reference. One commercially suitable heat-shrink suspension material is a SHRINX fabric available from Krall+Roth, Germany.

In one embodiment, the suspension material 70 is made from a fabric blank having a plurality of heat shrinkable, elastic (elastomeric) threads, configured as monofilaments in one embodiment, running in a first, lateral direction 4, or warp direction, and a plurality of non-extensible threads, configured as yarns or monofilaments in various embodiments, running in the same lateral/warp direction 4. It should be understood that the heat shrinkable, elastic threads (e.g., monofilaments) and non-extensible threads (e.g., monofilaments) may also run in the longitudinal direction 2. A plurality of yarn strands are interwoven with the elastomeric and non-extensible threads in the weft direction, or longitudinal direction 2 in one embodiment. The non-extensible threads and the yarn strands do not shrink when exposed to heat or energy, and are not elastomeric. Rather, the yarn strands provide shape control to the overall suspension material in a final configuration after heat shrinking. The yarn strands may be made of various colors, e.g., blue, to provide color to the textile material. The overall color of the blank is thereby easily changed simply by introducing different yarns in the weft direction. In contrast, the elastomeric threads are preferably transparent or black.

Figure 7A:
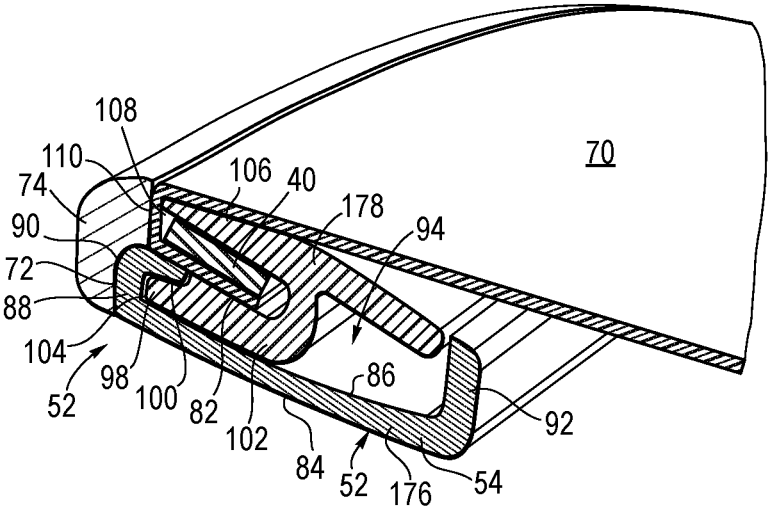
FIGS. 7A and B are cross-sections showing the connection between the suspension material and the frame.
Figure 7B:
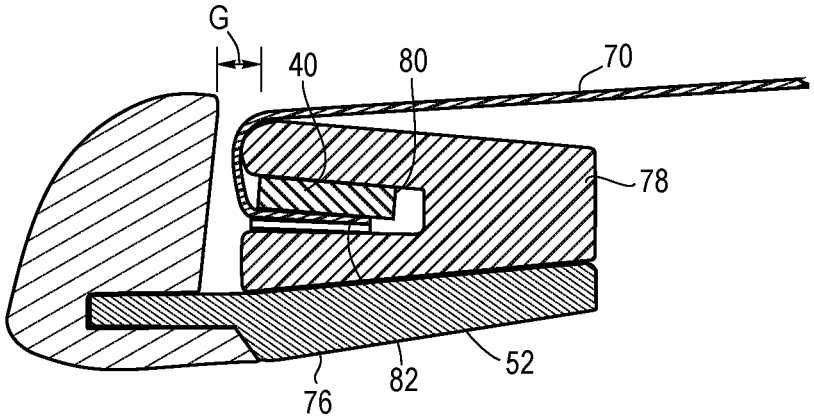

Referring to FIGS. 7A and B, an annular stay 40 is secured to the fabric blank for example by sewing or with staples or other fastening systems. The stay 40 may be installed in the support frame 52, with the support frame 52 and suspension 70 material then installed or coupled to the back frame 50.

Energy, such as heat, may be applied to the fabric blank from an energy source, causing the heat shrinkable elastomeric threads to shrink. In other embodiments, it should be understood that the suspension material 70 may be secured to the support frame with fasteners, such as staples, or with other configurations of stays, adhesives, loops surrounding the frame member.

Backrest Assembly:

Referring to FIGS. 1, 2 and 7A and B, the backrest assembly 6 includes a back frame 50 and a back support 52, otherwise referred to as a support frame. The back support 52, or support frame has opposite sides spaced apart in the lateral direction and a top and bottom spaced apart in a longitudinal direction. The back support, or support frame 52, includes a pair of laterally spaced uprights 54. A bottom portion 62 extends between and connects the uprights.

The uprights 54 of the back support are coupled to uprights 56 of the back frame with connectors 58. The uprights 54 are disposed laterally outwardly and forwardly of the uprights 56, with a lateral space defined therebetween. The back support 52 is pivotable with the back frame 50 relative to the base between at least an upright position and a reclined position. In one embodiment, the uprights 54, 56 may be pivotally connected with a mechanical pivot joint, or with the connector 58 extending laterally between one of the back frame uprights 56 and one of the back support uprights 54.

The back support 52 includes an upper member 60 extending between and connected to upper ends of the pair of uprights 54. The bottom portion 62 extends between and is connected to the lower ends of the second uprights 54. The upper member 60, uprights 54 and the bottom portion 62 define a ring in one embodiment, which in turn defines a central opening 66. A cross member 68 may extend between the uprights 54 between the upper member 60 and lower portion 62 across the opening 66. The uprights 52 may each having upper and lower portions 200, 202, defining separate first and second forwardly facing convex curvatures/curved surfaces 204, 206, with the cross member 68 extending between and coupled to the uprights at the junction between the upper and lower portions 200, 202. The upper and lower portions define a forwardly facing concave curved surface 208 at the junction thereof. At least opposite side portions of the suspension material 70 bear against and follow the contour of the upper and lower portions 200, 202, including having first and second forwardly facing convex curvatures overlying and mating with the front surface of the uprights, and concave curvature 208 overlying the junction. A laterally extending stay may be coupled to the suspension material and extends between the rear surface of the suspension material and the cross member 68 so as to pull the suspension material 70 rearwardly toward the cross member 68 and thereby define a seam 210 and provide forwardly facing convex and concave curvatures along a central portion of the suspension material laterally spaced, and at an intermediate location, relative to the uprights. The periphery of the suspension material is connected to the back support with a stay as disclosed herein elsewhere, for example in FIGS. 7A and B.

The suspension material 70 covers at least a portion of the opening 66, and in one embodiment, the entirety of the opening 66, including both portions thereof above and below the cross member 68. In one embodiment, the suspension material is disposed across the central opening and is secured to the uprights 54, upper member 60 and bottom portion 62, and may further be secured to the cross member 68. In other embodiments, the suspension material may only be secured to the spaced apart uprights, and the upper member and lower portions may be omitted.

In one embodiment, the upper member 60, the bottom portion 62 and the pair of uprights 54 defining the support frame 52 having a peripheral edge 72 as shown in FIGS. 7A and B. A flexible edge member 74 may be secured to the peripheral edge of the upper member 60 and uprights 54, and along a face of the bottom portion 62. The support frame 52 may be one-piece, or may be configured with two or more pieces, including for example an outer support frame 76 and a carrier frame 78 coupled to the outer support frame 76. The carrier frame 78 includes a peripheral groove 80 facing outwardly from a peripheral edge surface or face, oriented horizontally between the front and rear surfaces of the carrier frame, which is spaced apart from an inner surface or inwardly facing face of the flexible edge member 74 and defines a space or gap G therebetween. The groove 80 opens outwardly from the carrier frame 78 along the peripheral edge 72 thereof. The suspension material 70 is attached to at least one stay 40, configured as a ring in one embodiment, which may be secured along a peripheral edge portion 82 of the suspension member, wherein the at least one stay is disposed in the groove 80. The stay 40 may be held by friction alone, without any auxiliary support material such as adhesive, although additional anchors, such as adhesives of fasteners, may be used to secure one or both of the suspension material and stay to the carrier frame. In one embodiment, the stay directly 40 engages one surface of the groove 80, while the fabric engages the rear surface. In this way, the stay engages the surface of the groove 80 closest to the surface of the carrier frame covered by the fabric. In one embodiment, the stay 40 is formed as a continuous ring having a fixed length, with the stay 40 being relatively inelastic and resistant to elongation along a length thereof, but which may be flexible and bendable.

In another embodiment, and referring to FIG. 7A, the outer support frame 176 includes a rear wall 84 defining a body facing surface 86, an outer peripheral edge wall 88 having an outer surface 90 and an inner peripheral edge 92 wall, with the walls 88, 92 defining a forwardly facing channel 94. A lip 96, or catch, extends laterally inwardly from the outer peripheral edge wall and defines a channel 98 with the rear wall 84, with a rear surface of the lip defining an engagement surface 100. A carrier frame 178 has a body with a rear flange 102 defining a rear surface overlying and engaging the rear wall and an insert portion 104, defined by a plurality of tabs spaced apart around the periphery of the carrier frame 178 in one embodiment.

The insert portion 104 is received in the channel 98 and engages the engagement surface 100. The carrier frame 178 includes a second flange 106 that forms an outwardly facing groove 108 with the flange 102 and defines an outer peripheral edge wall 110. Tension applied by the suspension material 70 thereafter applies a moment to the carrier frame 178 causing it to bear up against the bottom surface of the support frame and the engagement surface. A flexible edge member 74 is coupled to the outer surface of the peripheral edge wall 88 of the support frame, with a lip portion overlying a top surface of the support frame. The flexible edge member 74 has an inner surface spaced apart from and facing inwardly toward the peripheral edge wall of the carrier frame, with the inner surface and the peripheral edge wall of the carrier frame defining a gap therebetween. A portion of the suspension material 70 is disposed in the gap, with the textile material covering the peripheral edge wall and body facing surface of the carrier frame. The carrier frame 178 may be secured to the outer support frame 176 with the overlapping tabs and fasteners, including mechanical fasteners and/or adhesive.

It should be understood that the support frame, and in particular the uprights, may be made of different materials and configurations than the disclosed support frame 52. For example, and without limitation, the support frame and uprights may be made of tubing, for example metal tubing, with the suspension material connected thereto with one or more loops arranged along each edge of the suspension material, or with various other fasteners, adhesives, hooks, staples, rivets, stays, etc., and combinations thereof, and that the particular connection between the suspension material and support frame, including the uprights, may be of any conventional and known configuration. It should be understood that the suspension material may be coupled only to the laterally spaced uprights, or only to the upper member and bottom portion, or to the uprights and one or the other of the upper member and bottom portion.

Figure 3:
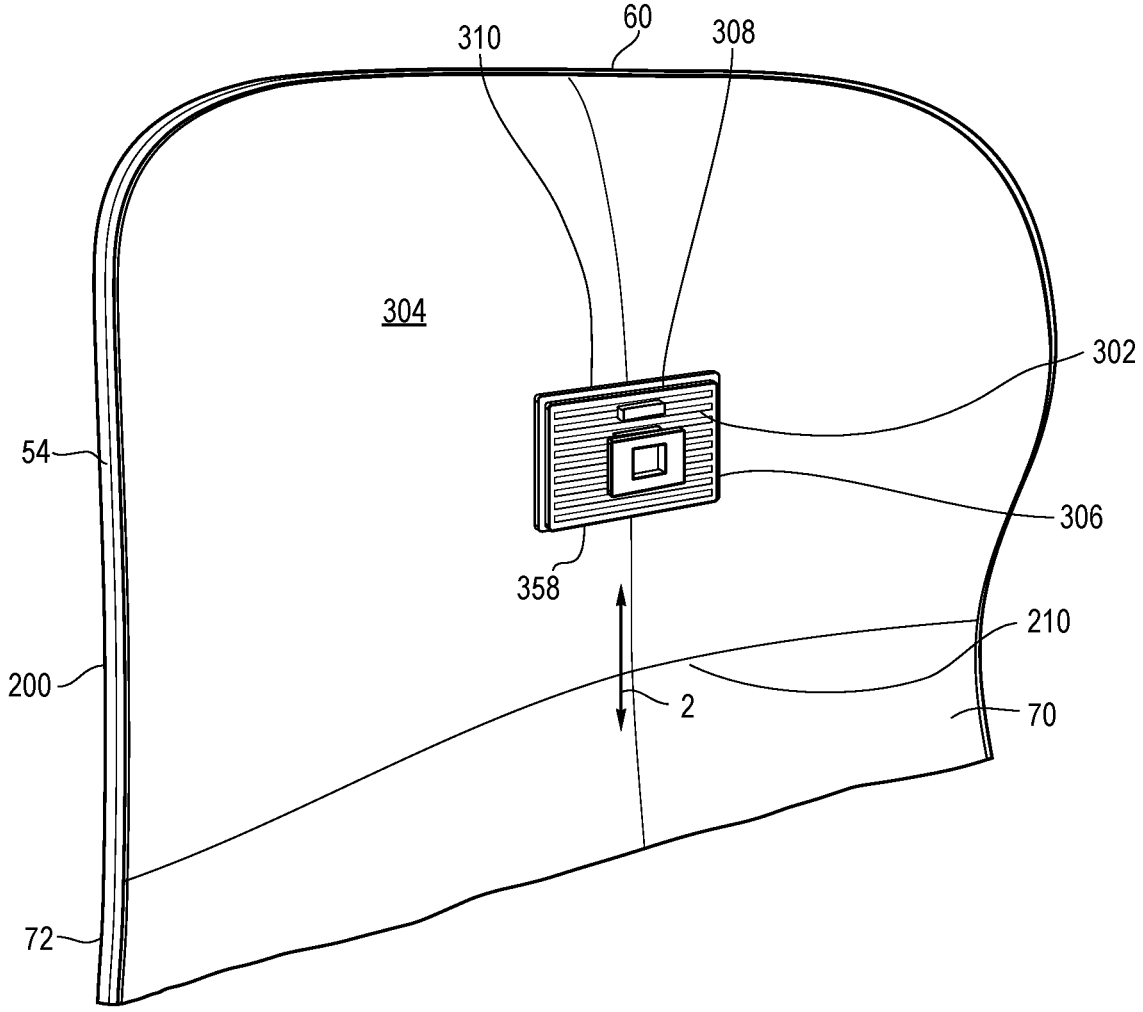
FIG. 3 is partial front view of a backrest with a support mount coupled thereto.
Figure 4:
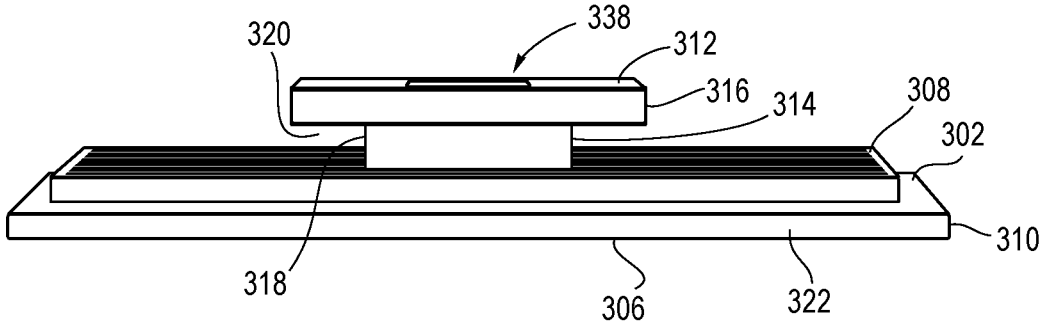
FIG. 4 is a top view of the support mount.
Figure 5:
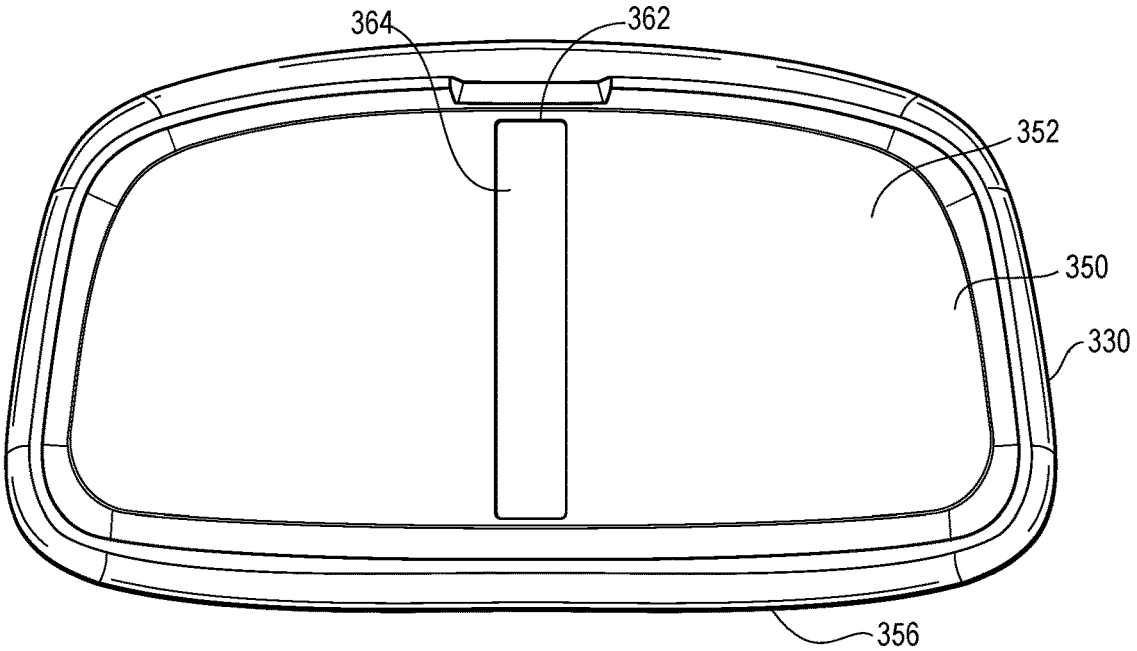
FIG. 5 is a rear view of a headrest.
Figure 6:
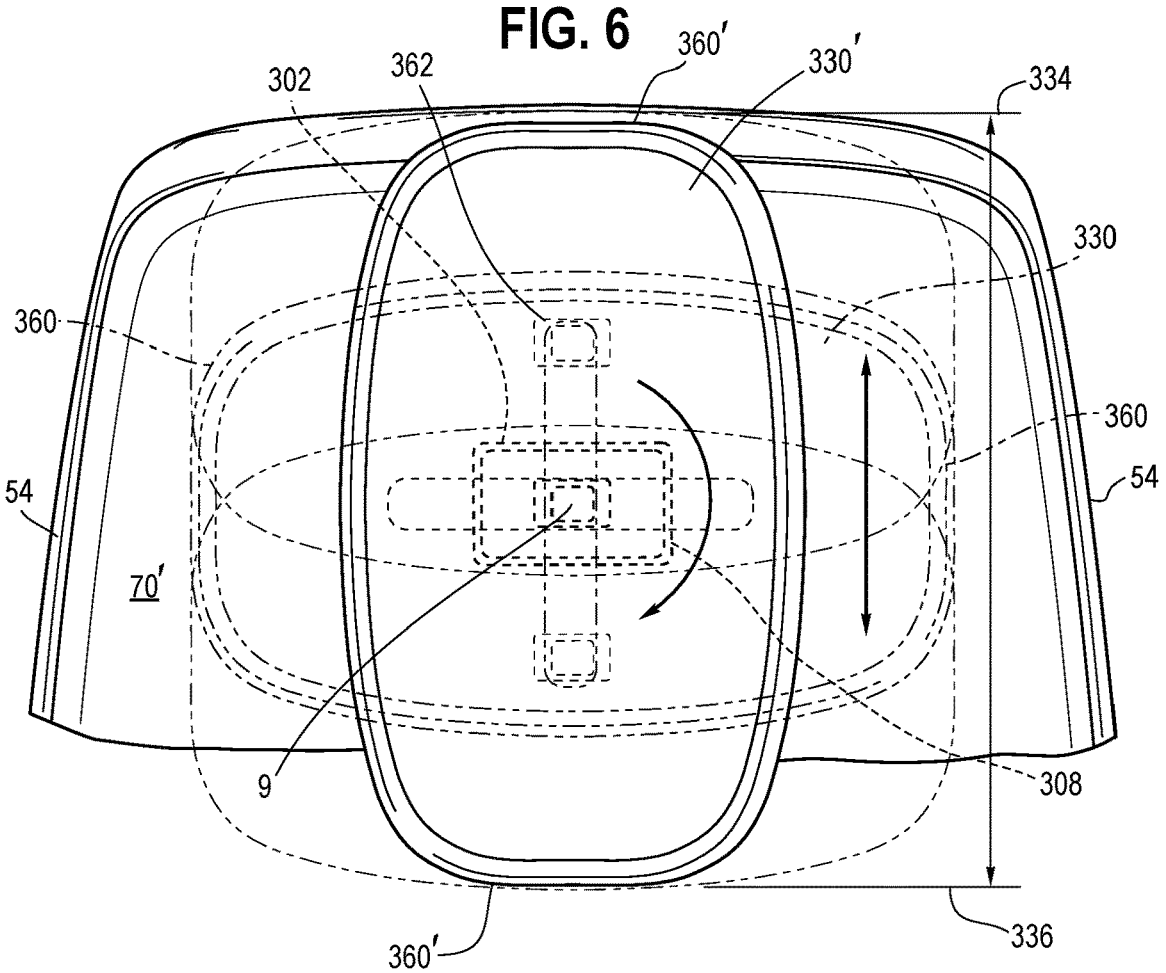
FIG. 6 is a schematic showing the assembly of the headrest.
Figure 8A:
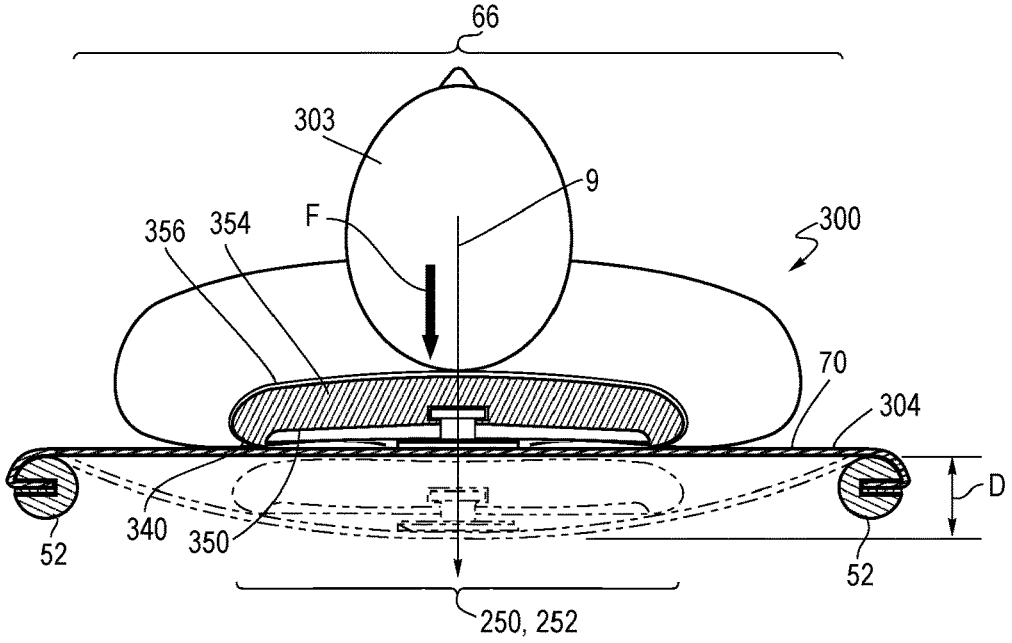
FIGS. 8A and B are schematic horizontal and vertical cross-sectional views showing a deflection of the suspension member and headrest.

As shown in FIGS. 3, 6 and 8A and B, at least a portion 252 of the suspension material at a location or region 250 spaced from the frame 52, and in particular the uprights 52, is deflectable in a fore/aft direction transverse to the opening 60 in response to a load F applied by a user. For example, the suspension material at the location or region 250 may be deflectable a distance D from a normal, unloaded condition to a loaded condition, with D varying along the longitudinal extent of the backrest and suspension material. It also should be understood that the at least a portion 252 of the suspension material at a location or region 252 spaced from the frame, and in particular the upper member 60 and cross member 68, is deflectable in a fore/aft direction transverse to the opening 66 in response to the load F. For example, the suspension material 70 at the location or region 250 may be deflectable a distance D from a normal, unloaded condition to a loaded condition.

Auxiliary Body Support Assembly:

Referring to FIG. 1, the backrest, or back support, may be configured with an adjustable auxiliary body support assembly 300, configured for example as a headrest in one embodiment. It should be understood that other body supports having a suspension material extending across an opening to support a user's body, including for example automotive and aircraft seating, lounge chairs, beds, etc., may also be configured with an auxiliary body support assembly 300 coupled to the suspension material as disclosed herein. In this way, it should be understood that the terms "backrest" and "back support" refer to systems supporting the body of the user, including a back portion of the user. Body support systems including a suspension material, together with the auxiliary body support assembly as disclosed herein, may also be configured to support other portions of the user's body, including the user's legs, thighs, buttock, arms, etc. In various exemplary embodiments, the auxiliary body support assembly 300 may also be located on other regions of the backrest, including the lumbar, sacral and thoracic regions, and may be configured as lumbar, sacral or thoracic supports. The auxiliary body support assembly 300 may be centered across the opening 66 along the longitudinal axis, or may be laterally offset from the axis. In one embodiment, the auxiliary body support assembly 300 includes a support mount 302 disposed on a front surface 304 of the suspension material 70, which extends between the laterally spaced uprights 54, including the upper portions 200 thereof, as disclosed above and spans the opening 66 defined between the uprights 54. The front surface 304 faces the body of the user, and may in one embodiment directly contact the body of the user. In one embodiment, the support mount 302 is coupled to the suspension material 70 at the location or region 250 that is spaced from the frame, for example laterally spaced from each of the uprights 54 and also vertically spaced from the upper member 60 and cross member 68. In one embodiment, the support mount 302 is connected only to the suspension material 70, and is not otherwise connected to the support frame 52 or any other structure, directly or indirectly, except by way of the intervening suspension material. Put another way, the support mount 302 is only connected to the support frame by way of the intervening suspension material 302. As such, support mount 302 may be moveable with the deflectable portion 252 of the suspension material in the fore/aft direction, i.e., Z axis direction 9. In one embodiment, the support mount 302 may have a platform 306 including a central region 308 and a peripheral edge portion 310 that extends radially outwardly from the central region. The edge portion 310 may be thinner than the central region 308. In one embodiment, the edge portion 310 is connected to the front surface 304 of the suspension material 70, for example, with a connector such as threads or stitching. The support mount 302, including the platform 306, may be connected to the suspension material with other connectors, such as fasteners, including screws, Christmas tree fasteners, rivets, other suitable fasteners, and/or adhesive. In one embodiment, the connector is not readily visible or discernable from a rear of the suspension material as shown in FIG. 2, for example with the stitching threads matching the suspension material threads, or with adhesive disposed on a front of the suspension material.

The support mount 302 includes a guide 312 extending forwardly, for example in a Z-direction, from the platform 306. The guide includes a stand-off portion 314 and a flange portion 316 extending laterally from both sides of the stand-off portion. The stand-off portion 314 and flange portions 316 define a T-shaped guide 312, or insert portion, having a pair of side channels 320. The rear surface 322 of the flanges define a stop surface. The stand-off portion 314 has a greater length than the flange portions 316 extending along the longitudinal direction 2, and includes side walls 318 that define an auxiliary guide surface.

Figure 8B:
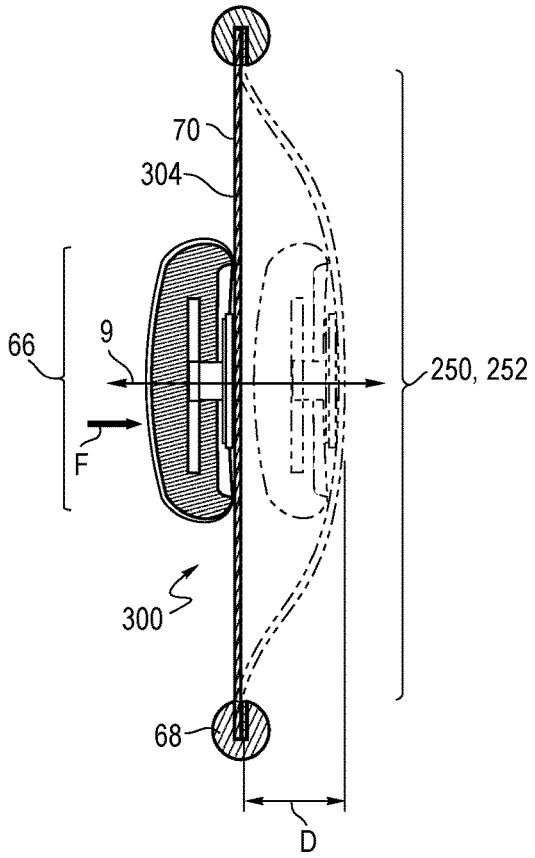

A body support member 330, for example a headrest, is moveably connected to the support mount 302. In one embodiment, the body support member 330 may be vertically moveable relative to the support mount 302 between at least uppermost and lowermost support positions 334, 336, as shown in FIG. 6. Referring to FIGS. 1 and 6, the body support member 330 covers an entirety of a front surface 338 of the support mount as the body support member 330 is moved between the uppermost and lowermost support positions 334, 336. As shown in FIGS. 1, 6 and 8, the body support member 330, including for example laterally spaced rear side portions 340 engages the suspension material 70 on opposite sides of the support mount 302, with the engagement creating a friction force that helps locate and hold the body support member 330 relative to the suspension material 70 in a desired location. The body support member 330 is continuously, or infinitely, adjustable relative to the suspension material 70 and support frame 52 in the vertical direction 2 between the uppermost and lowermost support positions 334, 336.

Figure 9:
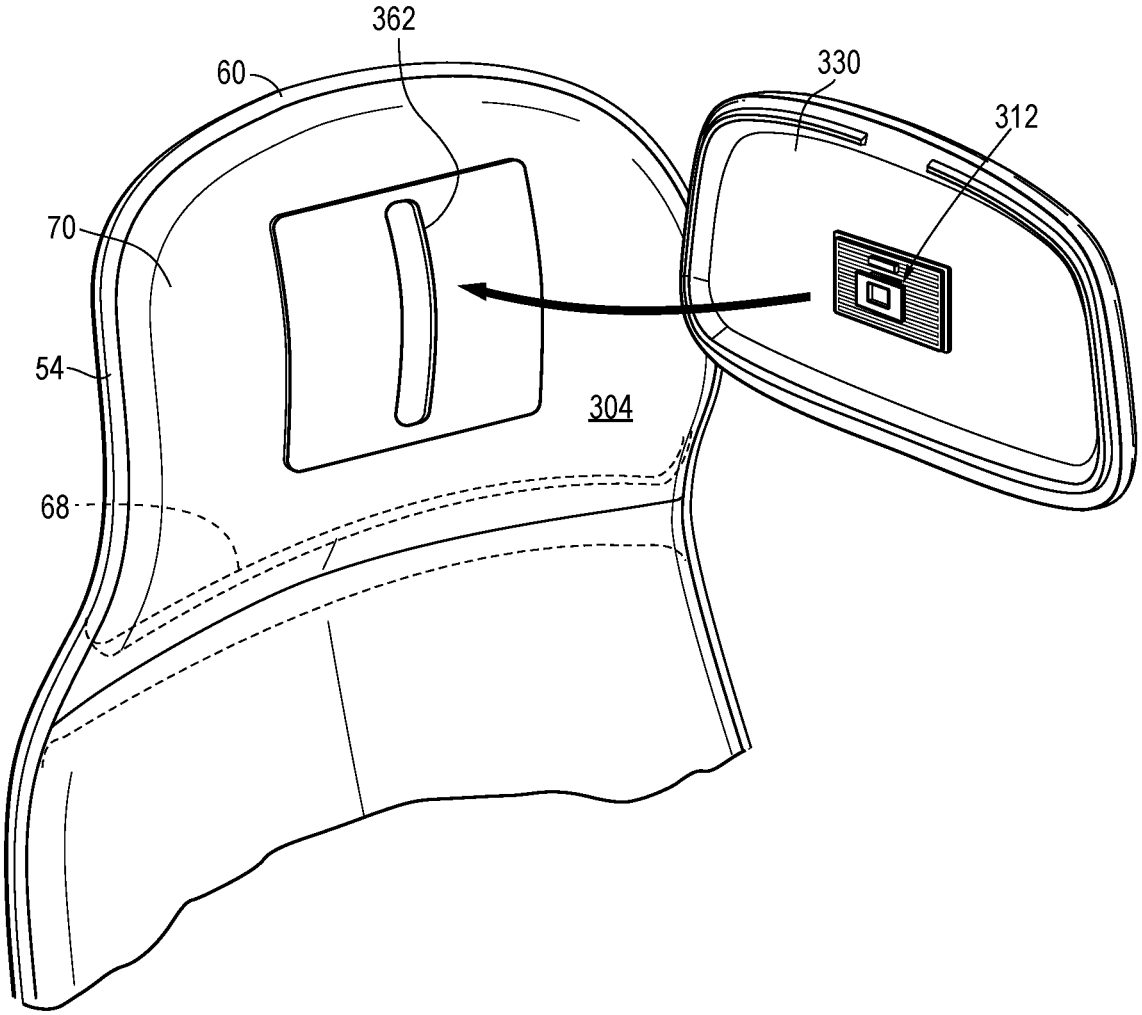
FIG. 9 is an exploded partial view of an alternative embodiment of a backrest and auxiliary body support assembly.

In one embodiment, the body support member 330 may include a shell 350 or interior frame defining a rear wall 352. A cushion 354 and upholstery cover 356 are connected to the shell 350 and define a front 358 and sides 360 of the body support member 330. The shell 350 is configured with a vertically extending track 362, defined by an elongated slot 364 or channel in one embodiment, which is shaped and dimensioned to receive the T-shaped guide 312, or insert portion. It should be understood that in an alternative embodiment, shown in FIG. 9, the body support member is configured with the guide 312, including a stand-off and flanges, while the support mount is configured with a track 362, which may be defined by a platform 380 secured to a front surface of the suspension material 70 as herein described.

During installation, and as shown in FIG. 6, the body support member 330 is rotatable around a transverse axis, e.g., Z-axis 9, between an engaged position, wherein the guide is non-releasably engaged with the track, and a disengaged position, wherein the guide is releasable from the track 362. In particular, the body support member 330' may first be oriented in a disengaged position with the sides 360' spaced apart in a vertical direction 2 such that the flanges 316 are aligned with and insertable through the slot 364. The body support member 330 is then rotated with the interior surface of the shell 350 sliding relative the flanges 316, or T-shaped connector, until the body support member 330 is oriented with the sides 360 spaced apart in a horizontal direction 4. In this orientation, the guide 312, and flanges 316 in particular, are engaged with the interior surface of the shell 350 with the stand-off 314 extending through the slot 364. In addition the edges of the shell defining the slot 364 engage and move alone the sidewalls 318, or auxiliary guide, of the stand-off. The engagement between the body support member 330 and suspension material 70 creates a force biasing the guide 312, and flanges 316 in particular, against the interior surface of the shell 350. The body support member 330 covers the front surface 338 of the support mount 302, and the coupling between the headrest and support mount, through the entire range of motion of the body support member 330, providing the body support member 330, for example a headrest, with a floating appearance, i.e., a floating headrest.

In operation, the support mount 302, which is coupled to the suspension material 70, is moveable with the suspension material 70 in the fore/aft direction as shown in FIGS. 8A and B as a user 303 applies a force F to the body support member 330 with one body component (e.g., a head, back, etc.) and applies a force F to a front surface 304 of the suspension material 70 (e.g., directly with a torso and indirectly through the body support member 330). The body support member 330 is moveably connected to the support mount 302, wherein the body support member 330 is vertically moveable relative to the support mount 302 between at least the uppermost and lowermost support positions. In one embodiment, the body support member 330 covers an entirety of the front surface 338 of the support mount as the body support member 330 is moved between the uppermost and lowermost support positions, although side, upper and lower portions of the support mount may be visible in some embodiments, and even portions of the front surface may be visible in some embodiments.

A method of assembling a backrest 6 includes providing a suspension material 70 coupled to a support frame 52, wherein at least a portion 252 of the suspension material is deflectable in a fore/aft direction relative to the frame. The method further includes inserting the guide 312 disposed on one of a body support member 330' or the suspension material 70 into the track 362 disposed on the other of the body support member or the suspension material, wherein the one of the guide or the track disposed on the suspension material is moveable with the suspension material in the fore/aft direction. The method includes rotating the body support member 330 relative to the suspension material and thereby engaging the track with the guide, for example by engaging the shell with the T-shaped insert portion, which is moveable in the elongated channel or slot. The method of assembly may be completed without tools or auxiliary fasteners such as screws or bolts through the simple manipulation (e.g., rotation) of the headrest relative to the backrest.

Referring to FIGS. 10-13B, another embodiment of a body support member is configured as a lumbar support 1100, which is connected to the pair of uprights 54 across the opening 66. The lumbar support 1100 extends between the uprights 54 and has a pair of hooks 1102 extending from opposite ends of the lumbar support. Due to the elastic connection between a central pad 1104 of the lumbar and the hooks, the hooks 1102 may pivot or rotate relative to the lumbar pad, allowing the hooks to follow the curved contour of the frame uprights 54 while the lumbar pad remains taught across the opening, as shown for example in FIGS. 13A and B, with the lumbar support 1100 in high and lower positons respectively. The lumbar support includes the central pad 1104, which has a pair of grooves 1106 extending along the upper and lower edges thereof. A looped band 1108, or cord, includes upper and lower cords 1110, 1112 positioned in the grooves, with looped end portions 1114 extending from and joining the upper and lower cords. The looped end portions 1114 are disposed in a U-shaped groove 1116 formed on an inboard end, or hub 1118, of an adapter 1120. The end portions 1114 are tucked or press-fit into the groove. The adapter includes an insert portion 1124, which is inserted into a passage in the end of the hook 1102. The looped band, including the upper and lower cords, allows the hook 1102 to rotate slightly relative to the pad 1104, for example when the lumbar is moved along a lower portion of a backrest frame uprights, which are tapered inwardly toward a centerline as shown in FIG. 99B. The looped band 1108 is flexible, with the cords 1110, 1112 being slightly pretensioned when the hooks are engaged with the outer edge of backrest frame. Due to the pretension, the lumbar support 1100 remains engaged with the frame even as the width dimension thereof is diminished as the lumbar support moves toward the bottom of the backrest.

Figure 10:
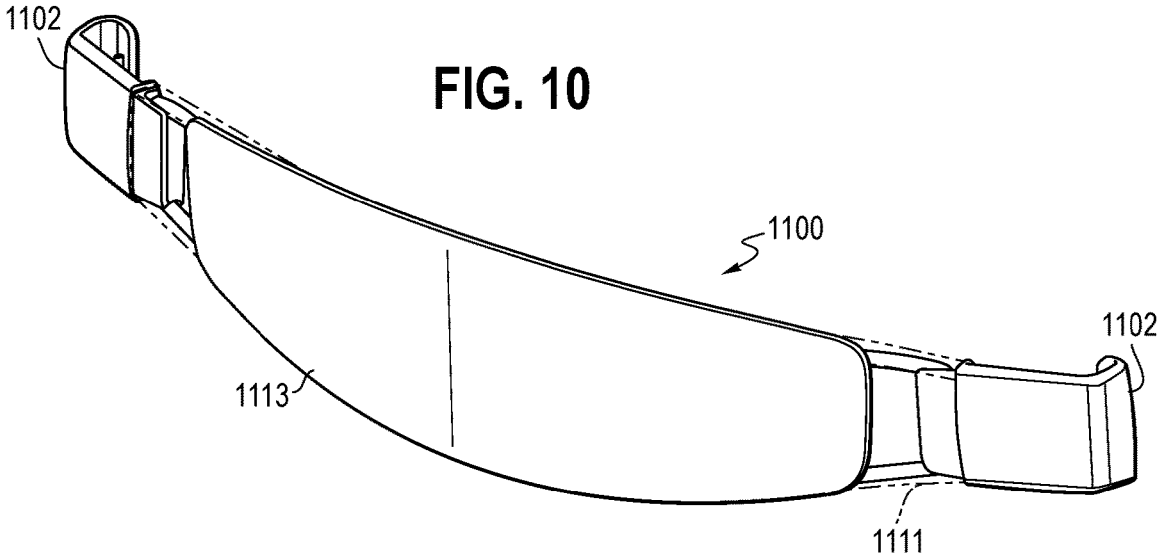
FIG. 10 is a rear view of a lumbar support.
Figure 11:
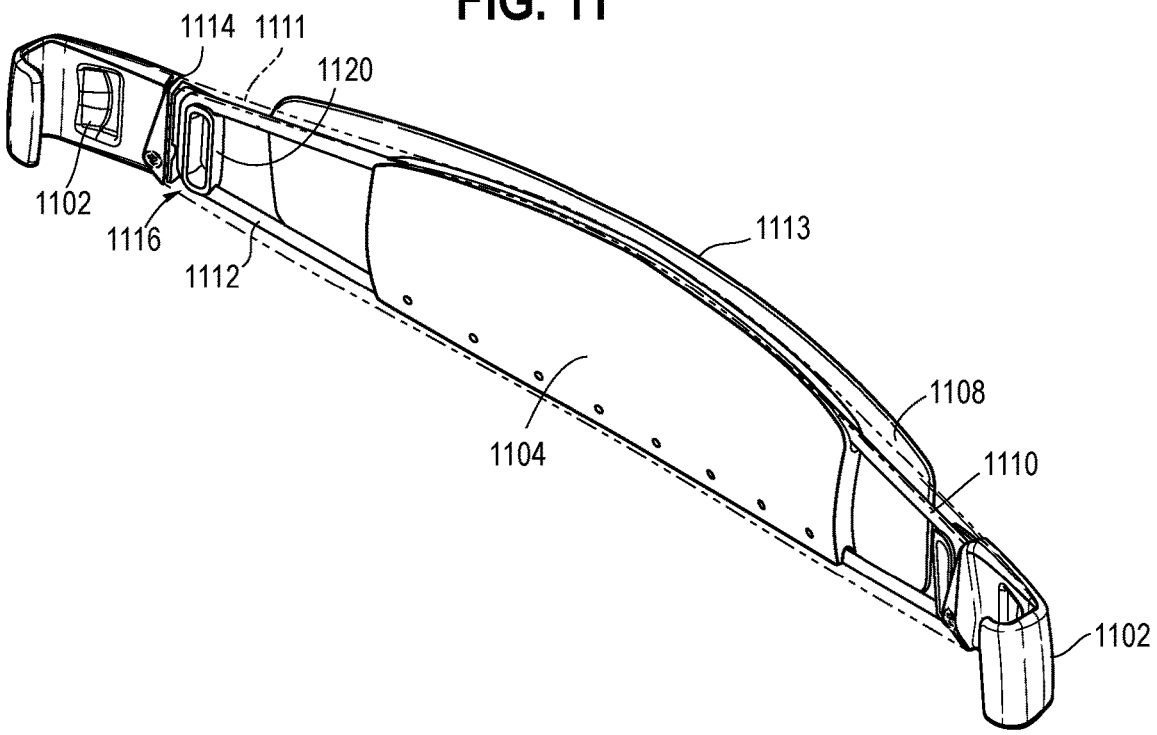
FIG. 11 is a partial front perspective view of the lumbar support shown in FIG. 10 without the sleeve.
Figure 12:
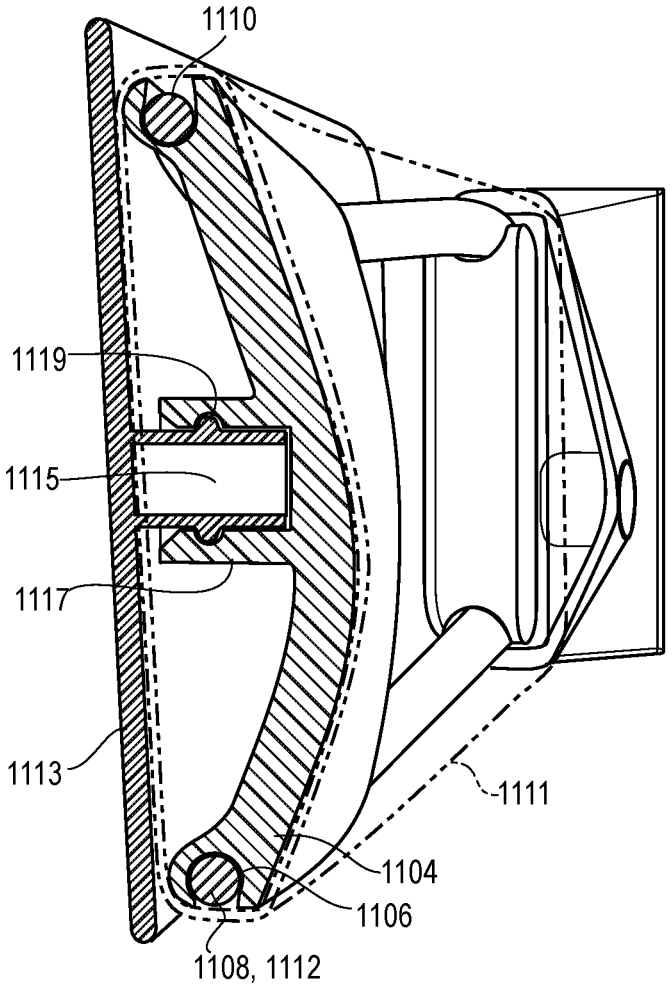
FIG. 12 is a cross-sectional view of the lumbar support shown in FIG. 10.
Figure 13A:
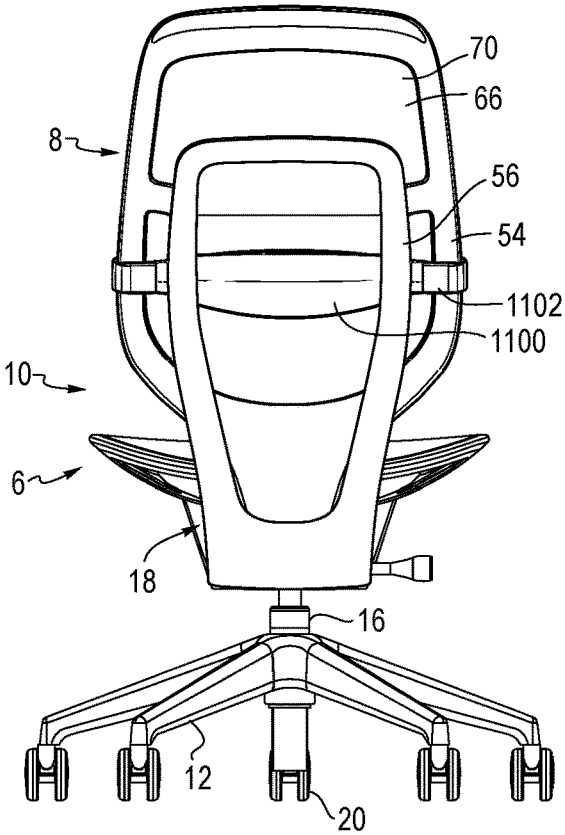
FIGS. 13A and B are rear views of a chair with a lumbar support applied thereto in upper and lower positions respectively.
Figure 13B:
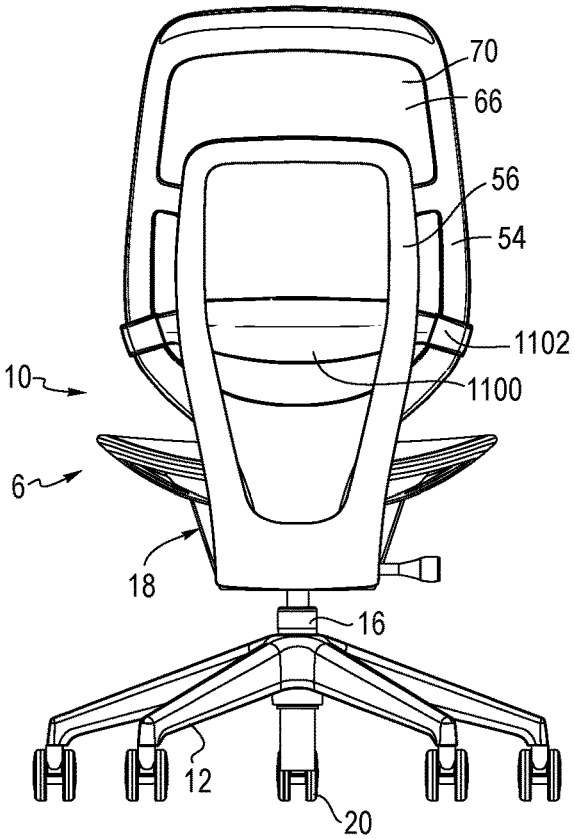

Referring to FIGS. 10 and 12, the central pad 1104 (e.g., printed or foam pad) may be fitted within an elastic sleeve 1111. Ends of the sleeve 1111 may be coupled to the adapters, for example the faces thereof, and abuts the end surface of the hook 1102, with the hook and sleeve being flush at the junction thereof. The sleeve 1111 is made of an elastic material, such as knit material. In this way, the sleeve provides both a pleasing aesthetic appearance while also providing function, namely allowing the lumbar to be tensioned, and lengthened or shortened, between the frame members. The elasticity of the sleeve maintains tension in the sleeve even as the hooks get closer together near the curved bottom of the frame. The front of the pad, or the sleeve covering the pad, engages the rear surface of the suspension material 70 and provides lumbar support to the user. A rear cover 1113 may cover the rear surface of the sleeve 1111, and has a greater height than the height of the sleeve 1111 as shown FIGS. 10 and 12. The cover 1113 may be configured as a thin sheet or plate with upper, lower and side edges, and includes at least one insert portion 1115 that extends forwardly from the cover. A hub 1117, or receptacle, extends rearwardly from the pad 1104. The hub 1117 or insert portion 1115 extends through the sleeve material 1111, for example through a hole defined in the sleeve material 1111. The hub and receptacle include catches 1119 that provide a snap-fit coupling between the cover 1113 to the pad 1104.

It should be understood that the overall appearance of the body support member, suspension material and auxiliary body support assembly, individually and collectively, including for example and without limitation the shape, relative size and curvature of the backrest, headrest and lumbar support, may be varied or configured in a manner that presents a different appearance without impairing the operation and function of the components shown, for example without affecting the relative motion, interface and interaction of those components, including the relative movement therebetween. Those of skill in the art will appreciate that the present configuration shown in those drawing figures, as well as other potential embodiments, are chosen based upon a selected aesthetic for presenting a desired ornamental design appearance that is operational but is not dictated by the functionality of the components and embodiments shown.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A body support assembly comprising:

a frame defining an opening;

a suspension material coupled to the frame and covering at least a portion of the opening, wherein at least a portion of the suspension material at a location spaced from the frame is deflectable in a fore/aft direction transverse to the opening; and an auxiliary body support assembly comprising:

a support mount coupled to the suspension material at the location spaced from the frame, wherein the support mount is moveable with the portion of the suspension material in the fore/aft direction; and a body support member moveably connected to the support mount, wherein the body support member is vertically moveable relative to the support mount between at least uppermost and lowermost support positions, wherein the body support member covers an entirety of a front surface of the support mount as the body support member is moved between the uppermost and lowermost support positions.

2. The body support assembly of claim 1 wherein the frame comprises a pair of laterally spaced uprights defining the opening therebetween, wherein the suspension material spans the opening and is coupled to the uprights, and wherein the support mount is coupled to the suspension material between the uprights.

3. The body support assembly of claim 1 wherein the support mount is disposed on a front surface of the suspension material.

4. The body support assembly body support assembly of claim 3 wherein the support mount is coupled to the suspension material with stitching.

5. The body support assembly of claim 1 wherein the body support member engages the suspension material on opposite sides of the support mount.

6. The body support assembly of claim 1 wherein one of the support mount or the body support member comprises a track and the other of the support mount or the body support member comprises a guide engaging the track.

7. A body support assembly comprising:

a frame defining an opening;

a suspension material coupled to the frame and covering at least a portion of the opening, wherein at least a portion of the suspension material at a location spaced from the frame is deflectable in a fore/aft direction transverse to the opening; and an auxiliary body support assembly comprising:

a support mount coupled to the suspension material at the location spaced from the frame, wherein the support mount is moveable with the portion of the suspension material in the fore/aft direction; and a body support member moveably connected to the support mount, wherein the body support member is vertically moveable relative to the support mount between at least uppermost and lowermost support positions;

wherein one of the support mount or the body support member comprises a track and the other of the support mount or the body support member comprises a guide engaging the track, wherein the body support member is rotatable around a transverse axis between an engaged position, wherein the guide is non-releasably engaged with the track, and a disengaged position, wherein the guide is releasable from the track.

8. A body support assembly comprising:

a frame defining an opening;

a suspension material coupled to the frame and covering at least a portion of the opening, wherein at least a portion of the suspension material at a location spaced from the frame is deflectable in a fore/aft direction transverse to the opening; and an auxiliary body support assembly comprising:

a support mount coupled to the suspension material at the location spaced from the frame, wherein the support mount is moveable with the portion of the suspension material in the fore/aft direction; and a body support member moveably connected to the support mount, wherein the body support member is vertically moveable relative to the support mount between at least uppermost and lowermost support positions;

wherein one of the support mount or the body support member comprises a track and the other of the support mount or the body support member comprises a guide engaging the track, wherein the guide member comprises a T-shaped insert portion, and wherein the track comprises an elongated channel shaped to receive the T-shaped insert portion.

9. The body support assembly body support assembly of claim 6 wherein the body support member comprises the track.

10. A body support assembly comprising:

a frame;

a suspension material coupled to the frame, wherein at least a portion of the suspension material is deflectable in a fore/aft direction relative to the frame; and an auxiliary body support assembly comprising:

a support mount coupled to the suspension material, wherein the support mount is moveable with the suspension material in the fore/aft direction; and a body support member moveably connected to the support mount, wherein the body support member is vertically moveable relative to the support mount between at least uppermost and lowermost support positions, wherein the body support member covers an entirety of a front surface of the support mount as the body support member is moved between the uppermost and lowermost support positions.

11. The body support assembly of claim 10 wherein the frame comprises a pair of laterally spaced apart uprights defining an opening between the uprights, wherein the suspension material is coupled to the uprights across at least a portion of the opening.

12. The body support assembly of claim 10 wherein the body support member engages the suspension material on opposite sides of the support mount.

13. The body support assembly of claim 10 wherein one of the support mount or the body support member comprises a track and the other of the support mount or the body support member comprises a guide engaging the track.

14. The body support assembly of claim 13 wherein the body support member is rotatable around a transverse axis between an engaged position, wherein the guide is non-releasably engaged with the track, and a disengaged position, wherein the guide is releasable from the track.

15. The body support assembly of claim 14 wherein the guide member comprises a T-shaped insert portion, and wherein the track comprises a channel shaped to receive the T-shaped insert portion.

16. The body support assembly of claim 10 wherein the support mount is disposed on a front surface of the suspension material.

17. The body support assembly of claim 10 wherein the body support member engages the suspension material on opposite sides of the support mount.

18. A method of assembling a body support assembly comprising:

providing a suspension material coupled to a frame, wherein at least a portion of the suspension material is deflectable in a fore/aft direction relative to the frame;

inserting a guide disposed on one of a body support member or the suspension material into a track disposed on the other of the body support member or the suspension material, wherein the one of the guide or the track disposed on the suspension material is moveable with the suspension material in the fore/aft direction; and rotating the body support member relative to the suspension material and thereby engaging the track with the guide.

19. The method of claim 18 further comprising moving the body support member vertically relative to the suspension material.

20. The method of claim 18 wherein the guide member comprises a T-shaped insert portion, and wherein the track comprises an elongated channel shaped to receive the T-shaped insert portion.

* * * * *